US006738484B2

(12) United States Patent
Nakabayashi

(10) Patent No.: US 6,738,484 B2
(45) Date of Patent: May 18, 2004

(54) PRESSURE RESPONSIVE DEVICE AND METHOD OF MANUFACTURING SEMICONDUCTOR SUBSTRATE FOR USE IN PRESSURE RESPONSIVE DEVICE

(75) Inventor: Masakazu Nakabayashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/969,764

(22) Filed: Oct. 4, 2001

(65) Prior Publication Data

US 2002/0172382 A1 Nov. 21, 2002

(30) Foreign Application Priority Data

May 18, 2001 (JP) ..... 2001-149760

(51) Int. Cl.[7] ..... H04R 25/00
(52) U.S. Cl. ..... 381/174; 381/113; 381/191
(58) Field of Search ..... 381/174, 190–191, 381/361, 369, 113, 173; 367/170; 310/309

(56) References Cited

U.S. PATENT DOCUMENTS

| | | | | | |
|---|---|---|---|---|---|
| 3,786,495 | A | * | 1/1974 | Spence | 341/33 |
| 4,321,432 | A | * | 3/1982 | Matsutani et al. | 381/174 |
| 4,524,247 | A | * | 6/1985 | Lindenberger et al. | 381/173 |
| 4,558,184 | A | * | 12/1985 | Busch-Vishniac et al. | 381/174 |
| 4,641,054 | A | * | 2/1987 | Takahata et al. | 310/324 |
| 5,147,435 | A | * | 9/1992 | Kubota et al. | 65/30.1 |
| 5,677,965 | A | * | 10/1997 | Moret et al. | 381/191 |
| 5,949,892 | A | * | 9/1999 | Stewart | 381/113 |
| 6,097,821 | A | * | 8/2000 | Yokoyama et al. | 381/191 |
| 6,178,249 | B1 | * | 1/2001 | Hietanen et al. | 381/174 |
| 6,188,773 | B1 | * | 2/2001 | Murata et al. | 381/361 |
| 6,383,832 | B1 | * | 5/2002 | Nakabayashi | 438/50 |
| 2002/0149294 | A1 | * | 10/2002 | Matsumoto et al. | 310/309 |
| 2002/0172389 | A1 | * | 11/2002 | Pavlovic | 381/369 |

FOREIGN PATENT DOCUMENTS

| | | | | |
|---|---|---|---|---|
| FR | 587032 A1 | * | 3/1994 | 381/174 |
| JP | 06098397 A | * | 4/1994 | H04R/17/00 |

OTHER PUBLICATIONS

U.S. patent application Ser. No. 09/956,805, filed Sep. 21, 2001, pending.
U.S. patent application Ser. No. 09/969,764, filed Oct. 4, 2001, pending.

* cited by examiner

*Primary Examiner*—Curtis Kuntz
*Assistant Examiner*—P. Dabney
(74) *Attorney, Agent, or Firm*—Oblon, Spivak, McClelland, Maier & Neustadt, P.C.

(57) ABSTRACT

A pressure responsive device capable of achieving thinning or miniaturization while maintaining a high performance and a method of manufacturing a semiconductor substrate for use therein. A back electrode is placed on a bottom surface of a concave formed on a central portion of a main surface of a semiconductor substrate. A peripheral edge portion of a vibrating electrode membrane is fixed on a peripheral surface surrounding the concave. In this manner, a capacitor including the back electrode/a space (air)/the vibrating electrode membrane is formed. The concave is formed by etching, and therefore a variation in depth of the concave in each apparatus is suppressed. As a result, a highly reliable and inexpensive pressure responsive apparatus is obtained.

14 Claims, 4 Drawing Sheets

PRIOR ART

PRESSURE RESPONSIVE DEVICE AND METHOD OF MANUFACTURING SEMICONDUCTOR SUBSTRATE FOR USE IN PRESSURE RESPONSIVE DEVICE

BACKGROUND OF THE INVENTION

1. Technical Field

The present invention relates to a pressure responsive device such as an electret condenser microphone or a pressure sensor for use in cellular phone or the like.

2. Background Art

FIG. 6 is a sectional view showing a conventional electret condenser microphone for use in cellular phone or the like. In the drawing, reference numeral 20 is a printed board on which a junction FET (hereinafter referred to as J-FET) 21 is mounted, and numeral 22 is a back plate. Numeral 23 is an electret membrane semi-permanently charged with an electrical charge (Q) by irradiating a polymer, e. g., polypropylene with an electronic beam. Numeral 24 is a spacer made of a plastic, and numeral 25 is a vibrating membrane disposed above the electret membrane 23 via the spacer 24 and coated with a surface electrode made of aluminum. This vibrating membrane 25 is opposite to the electret membrane 23 and the back plate 22 therebelow via a space, and forms a capacitor between these electret membrane 23 and back plate 22 and the vibrating membrane 25. Furthermore, numeral 26 is a retaining rubber for fixing the vibrating membrane 25. Numeral 27 is a holder for holding the back plate 22 and the electret membrane 23. Numeral 28 is a capsule including a vent hole 29, and numeral 30 is a cloth covering the vent hole 29.

In the conventional electret condenser microphone, the capacitor is constructed of the back plate 22, the electret membrane 23 and the vibrating membrane 25 having the surface electrode. When a sound pressure such as a sound or voice is transferred through the vent hole 29 of the capsule 28, the vibrating membrane 25 is vibrated by this sound pressure thereby a capacity (c) of the capacitor being varied. Since an electrical charge (Q) is constant, variation in a voltage (V) is produced on the basis of Q=CV. Applying the voltage variation to a gate electrode of J-FET 21 causes variation in drain current, which is detected in the form of voltage signal.

Since an electret condenser microphone is used for a take-along terminal, e. g., a cellular phone, further thinning and miniaturization thereof have been desired. In the conventional construction of above construction, however, the printed board 20, J-FET 21, the holder 27 and the like are used resulting in a large number of parts. Therefore thinning and miniaturization of the electret condenser microphone were difficult. Moreover in the mentioned conventional construction, a problem exists in that S/N ratio is lowered as being thin and small-sized, eventually resulting in worse performance.

SUMMARY OF THE INVENTION

The present invention was made in order to solve the above-discussed problems, and has an object of providing a pressure responsive device capable of achieving thinning or miniaturization thereof while maintaining a high performance. The invention also provides a method of manufacturing a semiconductor substrate for use therein.

A pressure responsive device according to the invention comprises:

a package including a storage chamber in an interior thereof; means for introducing an outside pressure into the storage chamber;

a semiconductor substrate placed in the storage chamber; and a capacitor placed on the semiconductor substrate and of which capacity varies according to the outside pressure introduced into the storage chamber;

wherein a concave having a bottom surface and a peripheral surface surrounding the concave are formed on one main surface of the semiconductor substrate, the capacitor is provided with a fixed electrode membrane placed on the bottom surface of the concave and a vibrating electrode membrane fixed on the peripheral surface so as to cover the concave and facing to the fixed electrode membrane through a space, and the vibrating electrode membrane vibrates according to variation in the outside pressure introduced into the storage chamber.

In the pressure responsive device according to the invention, it is preferable that the peripheral surface is a flat face positioned on a first plane, and the bottom surface of the concave has a flat face positioned on a second plane spaced away from and substantially parallel with the first plane.

In the pressure responsive device according to the invention, it is preferable that the semiconductor substrate includes a conversion circuit for converting variation in capacity of the capacitor due to vibration in the vibrating electrode membrane into a voltage signal.

In the pressure responsive device according to the invention, it is preferable that the semiconductor substrate is provided with communication means for communicating the space and the storage chamber.

In the pressure responsive device according to the invention, it is preferable that the communication means includes a communication groove running from the concave to an outer edge of the semiconductor substrate is formed on the one main surface of the semiconductor substrate.

In the pressure responsive device according to the invention, it is preferable that the semiconductor substrate has another main surface opposite to the mentioned one main surface and has an air vent hole running from the concave to this another main surface.

In the pressure responsive device according to the invention, it is preferable the package has an air vent hole on a bottom wall that overlaps with the air vent hole of the semiconductor substrate.

In the pressure responsive device according to the invention, it is preferable that the concave is in the range of 5 to 15 $\mu$m in depth.

In the pressure responsive device according to the invention, it is preferable the vibrating electrode membrane includes an electret membrane made of a polymer which is electrically charged and an electrode formed on the electret membrane.

In the pressure responsive device of above construction according to the invention, a fixed electrode membrane is placed on the bottom surface of the concave formed on the one main surface of the semiconductor substrate and the peripheral edge portion of the vibrating electrode membrane is fixed on the peripheral surface of the semiconductor substrate surrounding this concave, thereby forming a capacitor comprised of the fixed electrode membrane/the space/the vibrating electrode membrane. As a result, according to the invention, number of parts becomes smaller than that in the conventional apparatus of same type and moreover each part is thin and small-sized, and consequently it is possible to achieve thinning and miniaturization of the apparatus while maintaining a high performance.

In the mentioned pressure responsive device in which the peripheral surface of the semiconductor is the flat face positioned on the first plane, and the bottom surface of the concave is a flat face positioned on the second plane spaced away from and substantially parallel with the first plane, it is possible to obtain sufficiently large variation in capacity value of the capacitor according to variation in outside pressure.

In the pressure responsive device in which the semiconductor substrate is provided with the conversion circuit for converting variation incapacity of the capacitor into a voltage signal, any special part serving as a detecting circuit is not required and it is possible to obtain a smaller-sized pressure responsive device.

In the pressure responsive device in which the semiconductor substrate is provided with communication means for communicating the space and the storage chamber, air in the space easily gets in and out the storage chamber, and it is possible to easily vibrate the vibrating electrode membrane.

In the pressure responsive device in which the communication groove running from the concave to the outer edge of the semiconductor substrate on the one main surface of the semiconductor substrate, it is possible to easily form the communication means on the semiconductor substrate.

In the pressure responsive device in which an air vent hole running from the concave of the semiconductor substrate to another main surface is formed, air in the space easily gets in or out and, and it is possible to easily vibrate the vibrating electrode membrane.

In the pressure responsive device in which the package is also provided with an air vent hole communicating to the air vent hole of the semiconductor substrate, it is possible to give a substantially constant pressure from outside of the package to the space and effectively vibrate the vibrating electrode membrane.

In the pressure responsive device in which the concave is in the range of 5 to 15 $\mu$m in depth, it is possible to reduce influence of variation in depth of the concave and assure a moderate sensitivity.

In the pressure responsive device in which the vibrating electrode membrane includes the electret membrane made of a polymer which is electrically charged and the electrode formed on the electret membranethe, it is possible to effectively obtain variation in capacity value of the capacitor due to vibration of the vibrating electrode membrane.

A method of manufacturing a semiconductor substrate used in a pressure responsive device according to the invention, the semiconductor substrate having a concave with a bottom surface, a peripheral surface surrounding the concave, and at least one communication groove running from an inner circumference to an outer circumference of the peripheral surface on one main surface, the method comprising:

a first step of forming a first resist membrane on the entire one main surface of the semiconductor substrate;

a second step of patterning the first resist membrane so as to form an opening while leaving the first resist membrane on the peripheral surface, the opening is positioned on an inner portion of the peripheral surface;

a third step of forming a concave of 5 to 15 $\mu$m in depth through the opening using the first resist membrane as a mask;

a fourth step of removing the first resist; a fifth step of forming a second resist membrane so as to cover the concave and the peripheral surface;

a sixth step of patterning the second resist membrane so as to expose at least one passage running from the inner circumference to the outer circumference of the peripheral surface; and a seventh step of forming a communication groove of 2 to 3.5 $\mu$m in depth on the passage using the second resist membrane as a mask.

In the method of manufacturing a semiconductor substrate according to the invention, it is possible to form a concave on the one main surface of the semiconductor substrate through etching, and it is therefore possible to reduce variation in depth of the concave in device. As a result, it is possible to reduce variation in performance of each device and to produce highly reliable pressure responsive device in large quantities at a reasonable cost.

DESCRIPTION OF THE PREFERRED EMBODIMENTS

Several preferred embodiments of the present invention are hereinafter described with reference to the drawings.

Embodiment 1

Figure 1:
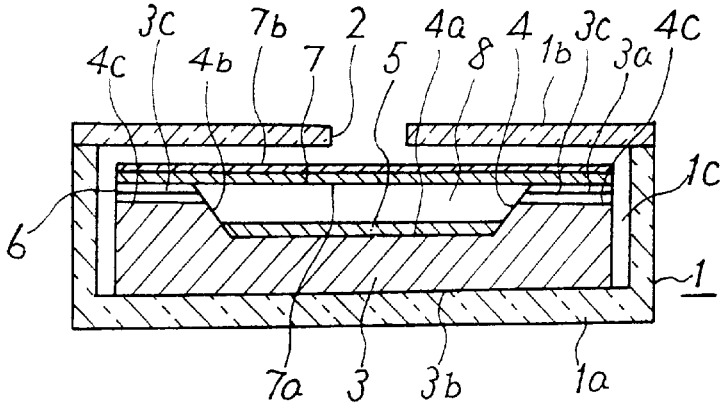
FIG. 1 is a sectional view showing a structure of an electret condenser microphone (ECM) according to Embodiment 1 of the present invention.

FIG. 1 is a sectional view showing a construction of an electret condenser microphone (hereinafter referred to as ECM), which is a pressure responsive device according to a first preferred embodiment of the invention. In the drawing, reference numeral 1 is a package having a storage chamber 1*c* constructed in an airtight manner in an interior thereof. This package 1 is comprised of a package body 1*a* and a top closure 1*b* covering an upper end of the package body 1*a* in an airtight manner. Numeral 2 is a vent hole formed in the top closure 1*b* as means for introducing an outside pressure into the storage chamber 1*c*. Numeral 3 is a square semiconductor substrate placed in the storage chamber 1*c*, and is comprised of a semiconductor material such as silicon. This semiconductor substrate 3 is provided with a pair of main surfaces 3*a*, 3*b* opposite to each other, and one of the main surfaces, the main surface 3*b*, is bonded to an inner face of the bottom of the package body 1*a* with a resin or solder. Numeral 4 is a concave formed on a central portion of the main surface 3*a* of the semiconductor substrate 3 and comprised of a bottom surface 4*a* having a flat plane parallel with the main surface 3*a* and an inclined side surface 4*b*. In other words, the concave 4 having the bottom surface 4*a* and the side surface 4*b* and a peripheral surface 3*c* surrounding the concave 4 are formed on the main surface 3*a* of the semiconductor substrate 3. Numeral 5 is a back electrode that is a fixed electrode membrane made of aluminum and placed on the bottom surface 4*a* of the concave 4, and numeral 6 is a silicon oxide membrane formed on the peripheral surface 3*c* of the semiconductor substrate 3 and bonded using such method as thermal oxidation of the semiconductor substrate 3, normal pressure CVD, P-CVD or the like.

Numeral 7 is a square-shaped vibrating electrode membrane fixed on the peripheral surface 3*c* of the semiconductor substrate 3 so as to cover the concave 4 and opposite to the back electrode 5 via the space 8. This vibrating electrode membrane 7 vibrates according to variation in outside pressure introduced into the storage chamber 1*c* and forms a capacitor together with the back electrode 5. In this embodiment, an electret membrane, in which a polymer 7*a* such as polypropylene is coated with a surface electrode 7*b* made of aluminum, is employed as the vibrating electrode membrane 7. Based on such a construction of the vibrating electrode membrane 7, the mentioned capacitor is comprised of the back electrode 5 /the space 8 (air)/the vibrating electrode membrane 7 having the surface electrode 7*b*. It is possible to use anode junction as a method for fixing the vibrating electrode membrane 7 on the peripheral surface of the semiconductor substrate 3. In this case, while keeping the vibrating electrode membrane 7 in contact with the silicon oxide membrane 6 on the peripheral surface 3*c* of the semiconductor substrate 3, a direct current voltage is applied utilizing the surface electrode 7*b* of the vibrating electrode membrane 7 as anode and the semiconductor substrate 3 as cathode, whereby the vibrating electrode membrane 7 is joined to the silicon oxide membrane 6 due to a produced anodic oxidation membrane.

Figure 2:
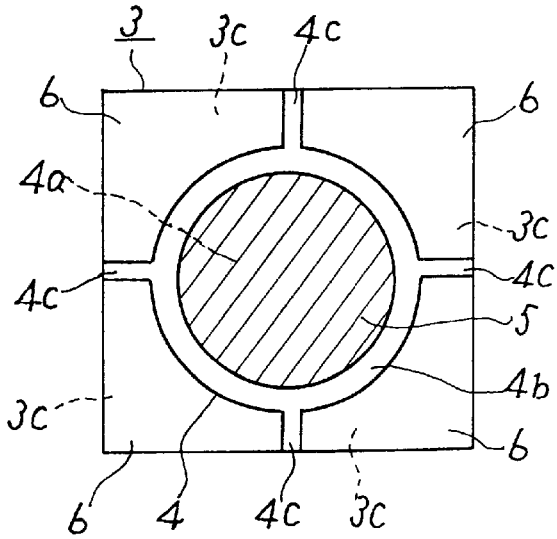
FIG. 2 is a top plan view of the semiconductor substrate used in ECM according to Embodiment 1 of the invention.

FIG. 2 is a plan view of the semiconductor substrate 3 for use in ECM of this embodiment, in which a substantially square-shaped semiconductor substrate 3 is employed. The main surface 3*a* being one of the main surfaces thereof includes the concave 4 and the peripheral surface 3*c* formed around the concave 4. The concave 4 is formed on the central portion of the main surface 3*a*, and the circular back electrode 5 is formed on the bottom surface 4*a*. The concave 4 is surrounded with the peripheral surface 3*c*, and this peripheral surface 3*c* is a flat face located on a first plane parallel with the main surface 3*b*. The bottom surface 4*a* of the concave 4 is a flat face located on a second plane spaced away from and substantially parallel with the first plane. An air communication groove 4*c* running from the concave 4 to the outer edge of the semiconductor substrate 3 is formed on the peripheral surface 3*c*. As a result, the space 8 between the concave 4 and the vibrating electrode membrane 7 communicates to the storage chamber 1*c* and the air in the space 8 easily gets in and out the storage chamber 1*c*, and it is therefore possible to easily vibrate the vibrating electrode membrane 7. In addition, the vibrating electrode membrane 7 is fixed on the peripheral surface 3*c* of the semiconductor substrate 3, and the air communication groove 4*c* runs under this fixed portion from the inner circumference to an outer circumference of the peripheral surface 3*c*, i. e., extends on a passage to the outer edge of the semiconductor substrate 3.

Note that, in this embodiment, the semiconductor substrate 3 is further provided with various signal-processing circuits such as a conversion circuit by which variation in capacity of the capacitor due to vibrations of the vibrating electrode membrane 7 is converted into a voltage signal and detected, an amplifier circuit, a noise reduction circuit for improving a sound quality, and an equalizer (these signal-processing circuits are not shown in the drawings). These circuit wires are laid on the side surface 4*b* of the concave 4 and on the peripheral surface 3*c*.

Now, operation is hereinafter described. In the ECM according to this embodiment, the capacitor is comprised of the fixed electrode membrane or the back electrode 5 placed on the bottom surface 4*a* of the concave 4 formed on the semiconductor substrate 3 and the vibrating electrode membrane 7 in which coating is applied to the surface electrode 7*b*. By preliminarily irradiating the vibrating electrode membrane 7 with an electronic beam, an electrical charge (Q) is semi-permanently fixed to the vibrating electrode membrane 7. When introducing an outside sound pressure such as sound through the vent hole 2 of the top closure 1*b* into the storage chamber 1*c*, the sound pressure vibrates the vibrating electrode membrane 7. As a result, variation in capacity (C) of the capacitor is generated. On the basis of Q=CV, the electrical charge(Q) is constant, and therefore variation in a voltage (V) appears. The semiconductor substrate 3 converts the variation in the capacity into a voltage signal, detects and amplifies the signal and then outputs the signal with improvement in sound quality thereby performing a function of a microphone.

Next, a method of manufacturing the semiconductor substrate 3 used in the ECM of this embodiment is hereinafter described. In particular, a step of forming the concave 4 having the bottom surface 4*a* on the one main surface 3*a* of the semiconductor substrate 3 and at least one air communication groove 4*c* running from the inner circumference to the outer circumference of the peripheral surface 4*c* surrounding the concave 4 is hereinafter described with reference to FIGS. 3(*a*) to (*e*). In the drawings, reference numeral 9*a* is a first resist membrane, and numeral 9*b* is a second resist membrane. In the drawings, the same reference numerals are designated to the same or like parts.

Figure 3:
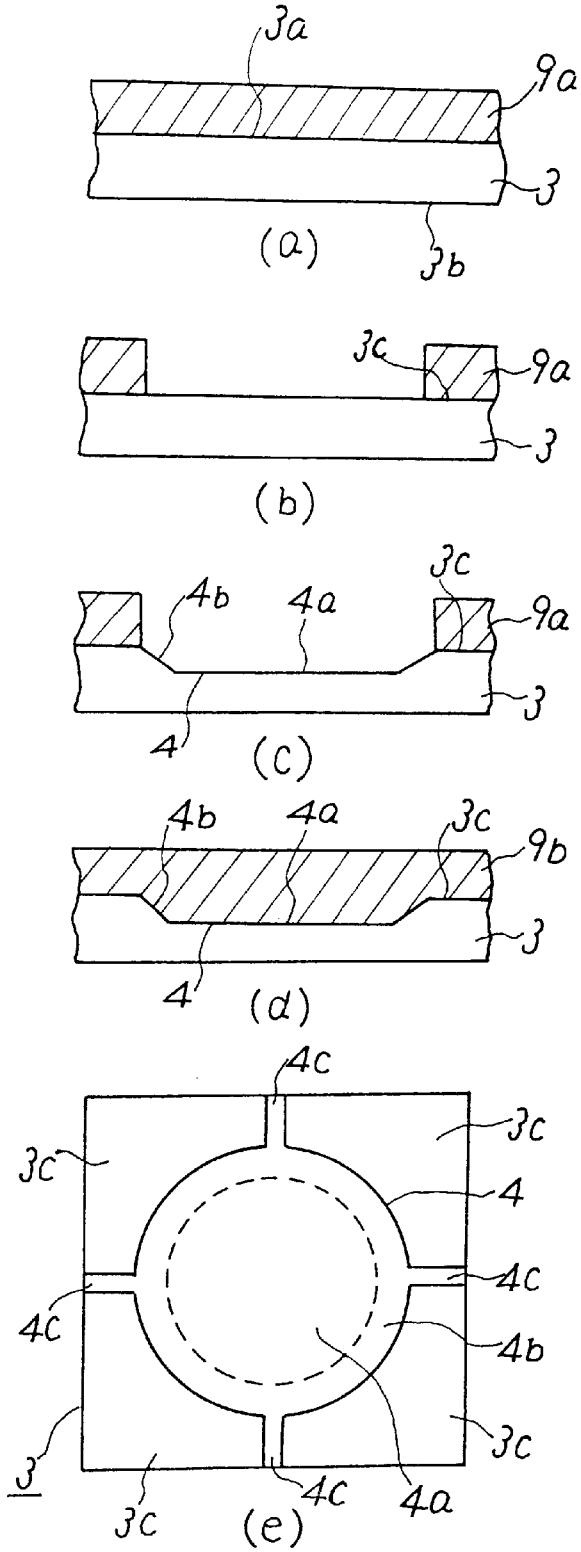
FIGS. 3(*a*) to (*e*) are sectional views and a plan view respectively showing a method of manufacturing the semiconductor substrate used in ECM according to Embodiment 1 of the invention.

First, the first resist membrane 9*a* is formed by applying a resist entirely on to the main surface 3*a* of the semiconductor substrate 3 (FIG. 3(*a*)). Then, the first resist membrane 9*a* is patterned by photomechanical process so as to leave the first resist membrane 9*a* on the peripheral surface 3*c* and to form an opening exposing the inner portion thereof (FIG. 3(*b*)). Subsequently, a part of the main surface 3*a* of the semiconductor substrate 3 is removed using this first resist membrane 9*a* as a mask through wet etching in which potassium hydroxide is used in order to form the concave 4 of 5 to 15 $\mu$m in depth in the inner circumference of the peripheral surface 3*c* (FIG. 3(*c*)), and thereafter the first resist membrane 9*a* is removed. The second resist membrane 9*b* is then formed so as to coat the concave 4 and the peripheral surface 3*c* there with (FIG. 3(*d*)). The second resist membrane 9*b* is patterned by photomechanical process so as to expose at least one passage running from the inner circumference to the outer circumference of the peripheral surface 3*c*. A part of the main surface 3*a* of the semiconductor substrate 3 is removed using this second resist membrane 9*b* as a mask through wet etching in which hydrofluoric acid and nitric acid are used in order to form the air communication groove 4*c* of 2 to 3.5 $\mu$m in depth in the foregoing passage (FIG. 3(*e*)). Thereafter, by performing predetermined steps such as formation of the back electrode 5 on the bottom surface 4*a* of the concave 4 of the semiconductor substrate 3, formation of various signal-processing circuits on the peripheral surface 3*c* and the side surface 4*b* of the concave 4, etc., the semiconductor substrate 3 used in the ECM of this embodiment is completed.

In the ECM of above construction, depth of the concave 4 formed on the main surface 3*a* of the semiconductor substrate 3 bears a direct relation to a value of the capacity of the capacitor greatly affecting the performance of microphone. When establishing the depth of the concave 4 to be smaller, it is certain that S/N ratio improves resulting in enhancement of sensitivity of microphone. However, being easily influenced by minute difference in depth of the concave 4 formed on each device, it comes out that fluctuation or irregularity in sensitivity of each microphone increases. The vibrating electrode membrane 7 is likely to be adsorbed to the back electrode 5 formed on the bottom surface 4*a* of the concave 4, eventually resulting in deterioration of sensitivity in high-sound regions. On the contrary, when establishing the depth of the concave 4 to be larger, being not easily influenced by minute difference in depth of the concave 4, it is certain that fluctuation or irregularity in sensitivity of each microphone is suppressed, but the sensitivity of microphone is deteriorated. Consideration of these aspects leads to a conclusion that it is appropriate to establish the depth of the concave 4 to be in the range of 5 to 15 $\mu$m. In this embodiment, the depth is established to be 7 $\mu$m. Note that it is still important to control as much as possible variation or difference in depth even if the depth is established within this range.

Figure 6:
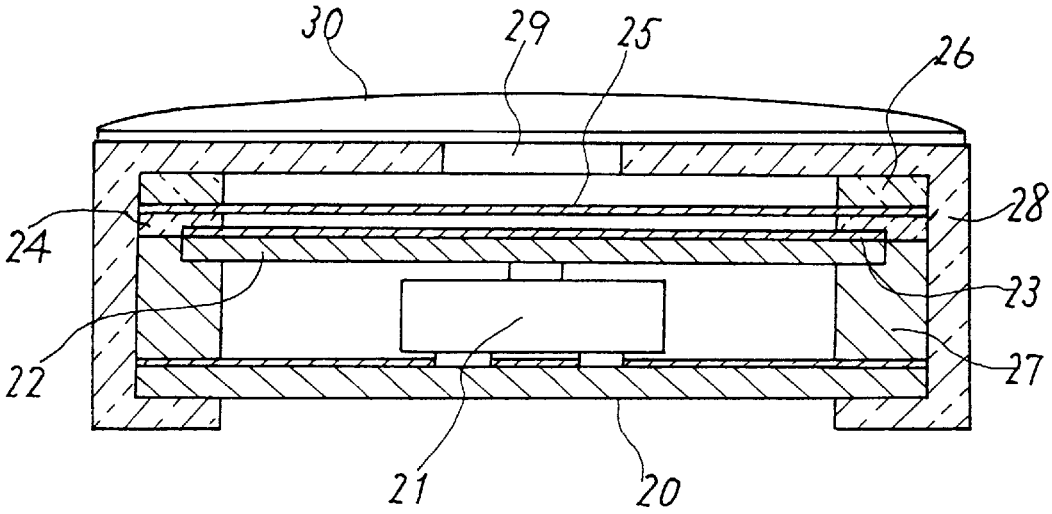
FIG. 6 is a sectional view showing a construction of the conventional ECM.

In case of the conventional structure shown in FIG. 6, the space conditioning the capacity value of the capacitor is established depending on height of the plastic spacer 24, and moreover, a large number of parts including the holder 27, spacer 24, and retaining rubber 26 are employed. It is therefore necessary to strictly control accuracy both in size of the spacer 24 and in assembling those parts. As a result, it is difficult to suppress fluctuation or irregularity in sensitivity of each microphone.

On the other hand, in this embodiment, number of parts becomes smaller than that in the conventional apparatus of same type and each part is thin and small-sized. Therefore it is possible to achieve thinning or miniaturization while maintaining a high performance. Further, it is possible to strictly control the depth of the concave 4 on a unit of $\mu$m by using a highly accurate etching technology, and consequently, fluctuation or irregularity in performance of each individual device is suppressed and a highly reliable pressure responsive device is obtained. Furthermore, in this embodiment, the semiconductor substrate 3 is easily manufactured using a method similar to a conventionally popular method of manufacturing a semiconductor apparatus, and it is therefore possible to produce ECM of high performance at a reasonable cost on a large scale.

Embodiment 2

Figure 4:
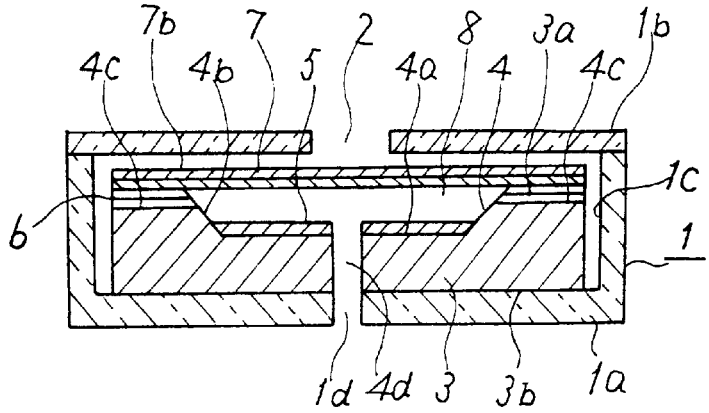
FIG. 4 is a sectional view showing a structure of ECM according to Embodiment 2 of the invention.

FIG. 4 is a sectional view of a construction of ECM showing a pressure responsive apparatus according to a second embodiment of the invention. In the drawing, reference numeral 4*d* is an air vent hole, which is communication means formed on semiconductor substrate 3 in order to allow the space 8 to communicate to the outside. The air vent hole 4*d* extends passing from the bottom surface 4*a* of the concave 4 to the main surface 3*b* of the semiconductor substrate 3. Furthermore, another air vent hole 1*d* is formed on the bottom wall of the package body 1*a* overlapping with the air vent hole 4*d* in order to allow the space 8 to communicate to the outside. In the drawings, the same reference numerals are designated to the same or like parts, and further description thereof is omitted herein.

In the ECM of the foregoing Embodiment 1, the space 8 is provided for communication to the storage chamber 1*c* by forming the air communication groove 4*c* (see FIG. 2) on the peripheral surface 3*c* of the semiconductor substrate 3.

On the other hand, in this embodiment, the space 8 is provided for communication to the outside by forming the air vent hole 4*d* passing from the bottom surface 4*a* of the concave 4 to the main surface 3*b* of the semiconductor substrate 3 and further forming the air vent hole 1*d* on the bottom wall of the package body 1*a*. As a result, it is possible to let air easily get in and out also between the space 8 and the outside of the package 1 and to introduce substantially a constant pressure from outside of the package into the space. Therefore the vibrating electrode membrane 7 is easily vibrated.

In this embodiment, a hole is also formed on the back electrode 5 placed on the bottom surface 4*a* of the concave 4, but it does not cause any problem because the hole is a very small hole serving as an air vent. In the ECM according to this embodiment, it is possible to omit the air communication groove 4*c* on the peripheral surface 3*c* of the semiconductor substrate 3. The remaining construction of the ECM in this second embodiment is the same as that in the foregoing Embodiment 1, and the same advantage is performed.

In the foregoing Embodiment 1 and Embodiment 2, as the vibrating electrode membrane 7 forming a capacitor together with the back electrode 5 formed on the bottom surface 4*a* of the concave 4, an electret membrane wherein the polypropylene is coated with electrode is used as an example. However, the invention is not limited to such an example, and it is also preferable to utilize, for example, any other polymer, ceramic membrane or the like. Further, although ECM is described taking as an example in the foregoing embodiments, note that the invention is also applicable to a pressure sensor.

The semiconductor substrate 3 and the vibrating electrode membrane 7 used in the foregoing embodiments are square-shaped. However, the semiconductor substrate 3 and the vibrating electrode membrane 7 are not limited to be square-shaped, and it is also preferable that the semiconductor substrate 3 and the vibrating electrode membrane 7 are rectangular or circular.

Anode junction is used as a method for fixing the peripheral edge portion of the vibrating electrode membrane 7 on the peripheral surface 3*c* of the semiconductor substrate 3. It is, however, also preferable to fix the peripheral edge portion of the vibrating electrode membrane 7 using an adhesive such as an epoxy adhesive.

Figure 5:
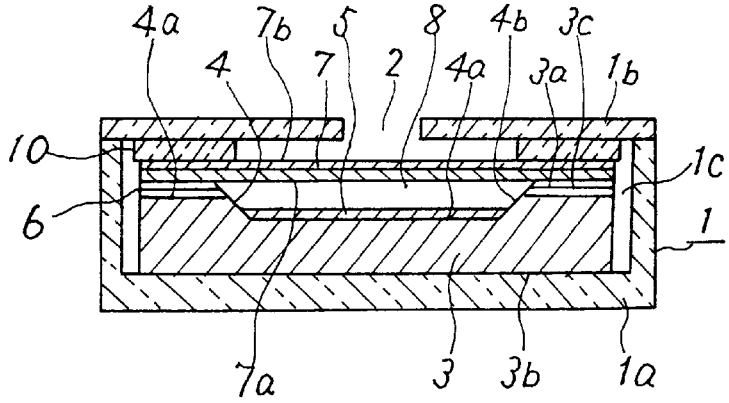
FIG. 5 is a sectional view showing another structure of ECM according to Embodiment 1 of the invention.

As shown in FIG. 5, it is also preferable to fix the peripheral edge portion of the vibrating electrode membrane 7 on the peripheral surface 3*c* of the semiconductor substrate 3 by retaining with a retainer rubber 10 of silicon.

What is claimed is:

1. A pressure responsive device comprising:

a package including a storage chamber in an interior of the package;

means for introducing an outside pressure into the storage chamber;

a semiconductor substrate placed in the storage chamber; and a capacitor placed on the semiconductor substrate and having a capacitance which varies according to the outside pressure introduced into the storage chamber, wherein a concave having a bottom surface and a peripheral surface surrounding the concave are formed on one main surface of the semiconductor substrate, the capacitor includes a fixed electrode membrane placed on the bottom surface of the concave and a vibrating electrode membrane fixed on an entirety of the peripheral surface completely covering the concave and facing the fixed electrode membrane through a space, and the vibrating electrode membrane vibrates according to a variation in the outside pressure introduced into the storage chamber, and wherein the concave and the vibrating electrode membrane form a communication groove running horizontally from the concave to an outer peripheral edge of the semiconductor substrate formed on the one main surface of the semiconductor substrate.

2. The pressure responsive device according to claim 1, wherein the peripheral surface is a first flat face positioned on a first plane, and the bottom surface of the concave has a second flat face positioned on a second plane spaced away from and substantially parallel with the first plane.

3. The pressure responsive device according to claim 1, wherein the semiconductor substrate includes a conversion circuit for converting variation in the capacitance of the capacitor due to vibration in the vibrating electrode membrane into a voltage signal.

4. The pressure responsive device according to claim 1, wherein the semiconductor substrate has another main surface opposite to the one main surface and has an air vent hole running from the concave to the another main surface.

5. The pressure responsive device according to claim 4, wherein the package has an air vent hole on a bottom wall that overlaps with the air vent hole of the semiconductor substrate.

6. The pressure responsive device according to claim 1, wherein the concave is in the range of 5 to 15 $\mu$m in depth.

7. The pressure responsive device according to claim 1, wherein the vibrating electrode membrane includes an electret membrane made of a polymer which is electrically charged and an electrode formed on the electret membrane.

8. A pressure responsive device comprising:

a package including a storage chamber in an interior of the package, the package having a vent hole introducing an outside pressure into the storage chamber;

a semiconductor substrate placed in the storage chamber, the semiconductor substrate including a first main surface and a second main surface opposing the first main surface, the first main surface having a concave shape by etching the semiconductor substrate, the first main surface further having a peripheral surface surrounding the concave, the concave having a bottom surface;

an over layer formed on the peripheral surface of the first main surface; and a capacitor including a fixed electrode membrane placed on the bottom surface of the concave and a vibrating electrode membrane fixed in contact with an entirety of the over layer completely covering the concave and facing the fixed electrode membrane through a space, the vibrating electrode membrane configured to vibrate according to a variation in the outside pressure into the storage chamber.

9. The pressure responsive device according to claim 8, wherein the peripheral surface is a first flat face positioned on a first plane, and the bottom surface of the concave has a second flat face positioned on a second plane spaced away from and substantially parallel with the first plane.

10. The pressure responsive device according to claim 8, further comprising a communication groove running from the concave to an outer edge of the semiconductor substrate formed on the first main surface of the semiconductor substrate.

11. The pressure responsive device according to claim 8, wherein the semiconductor substrate is a silicon substrate and the over layer is a silicon oxide layer.

12. The pressure responsive device according to claim 8, wherein the over layer is fixed to the peripheral main surface of the first main surface.

13. The pressure responsive device according to claim 8, wherein the concave is in the range of 5 to 15 $\mu$m in depth.

14. The pressure responsive device according to claim 8, wherein the vibrating electrode membrane includes an electret membrane made of a polymer which is electrically charged and an electrode formed on the electret membrane.

* * * * *